US008920059B2

(12) United States Patent
Kravchenko

(10) Patent No.: US 8,920,059 B2
(45) Date of Patent: Dec. 30, 2014

(54) DIAPER RASH CREAM APPLICATOR

(76) Inventor: Alina Kravchenko, San Francisco, CA (US)

( * ) Notice: Subject to any disclaimer, the term of this patent is extended or adjusted under 35 U.S.C. 154(b) by 692 days.

(21) Appl. No.: 12/903,738

(22) Filed: Oct. 13, 2010

(65) Prior Publication Data

US 2012/0093567 A1 Apr. 19, 2012

(51) Int. Cl.

| | |
|---|---|
| ***A46B 11/00*** | (2006.01) |
| ***A45D 40/22*** | (2006.01) |
| ***A45D 40/26*** | (2006.01) |
| *A45D 40/00* | (2006.01) |

(52) U.S. Cl.

CPC ..... *A45D 40/262* (2013.01); *A45D 40/22* (2013.01); *A45D 2040/0012* (2013.01); *A45D 2200/1009* (2013.01); *A45D 2200/25* (2013.01)

USPC ..... 401/290; 401/131; 401/269; 401/202

(58) Field of Classification Search

USPC ..... 401/131, 202, 213, 243, 262, 269, 290, 401/183–186, 48

See application file for complete search history.

(56) References Cited

U.S. PATENT DOCUMENTS

| | | | | | |
|---|---|---|---|---|---|
| 506,156 | A * | 10/1893 | Chase | ..... | 401/183 |
| 3,817,426 | A * | 6/1974 | Fooks | ..... | 222/105 |
| 5,263,787 | A * | 11/1993 | Wilcox et al. | ..... | 401/131 |
| 5,348,543 | A * | 9/1994 | Talley | ..... | 604/192 |
| 6,305,864 | B1 * | 10/2001 | Nguyen | ..... | 401/131 |

* cited by examiner

*Primary Examiner* — David Walczak
(74) *Attorney, Agent, or Firm* — Scot S. Fagerland, Esq.

(57) ABSTRACT

An applicator apparatus can be attached and detached to and from any tube container that properly fits. The tube is not part of the invention, but works with the invention as a handle and as a dispenser. When the tube is attached to the applicator apparatus, the hole of the tube in which the tubes contents come out of, meets with the hole of the applicator apparatus. The applicator apparatus's hole is surrounded by an applicator material such as brush bristles or sponge. When the tube is squeezed, the tubes contents will come out of the hole of the applicator apparatus and be introduce onto the surrounding bristles of the brush or sponge of the applicator apparatus. The applicator apparatus attaches to a lid. The top portion of the lid has an opening in which the applicator apparatus can be placed into. The bottom portion of the lid can have a suction cup base that is to be secured onto a flat hard surface or a pull tab that can be taken off by a humans mouth. The combination of the applicator apparatus working with the lid allows for a human to perform the entire application process without contaminating ones hand with the tubes contents, and while only using one hand.

3 Claims, 13 Drawing Sheets

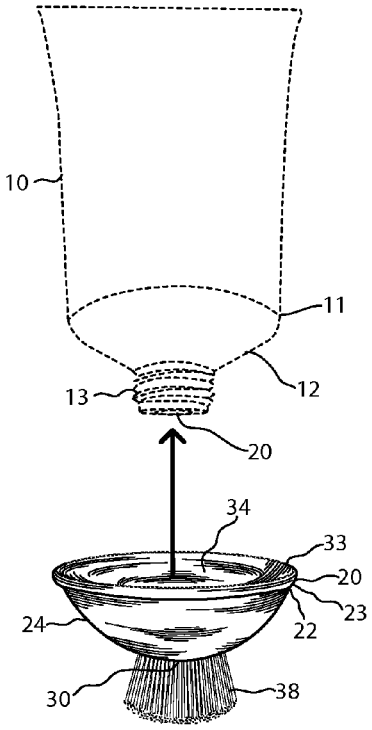
FIG. 2A
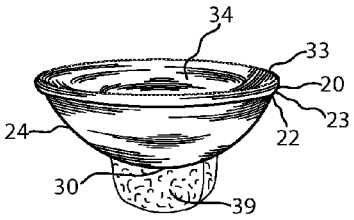
FIG. 2A.1
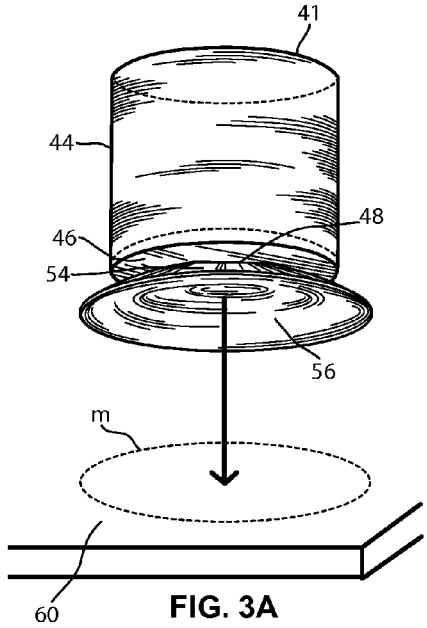
FIG. 3A
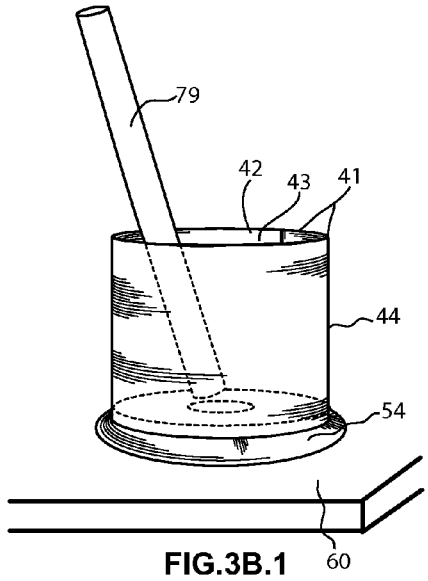
FIG.3B.1

FIG.2B.1

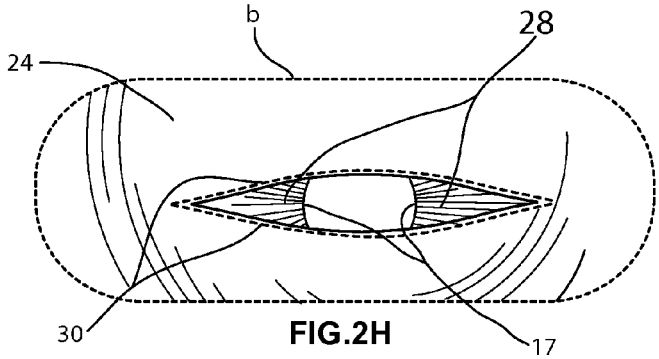
FIG.2H
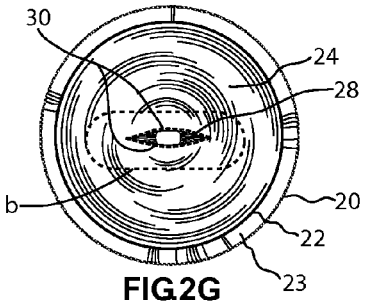
FIG.2G
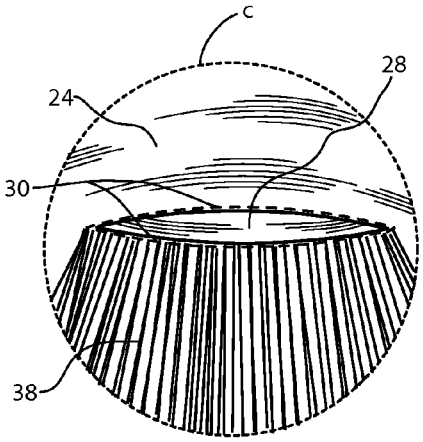
FIG.2F
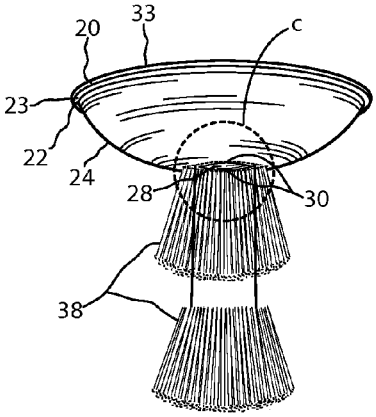
FIG. 2E
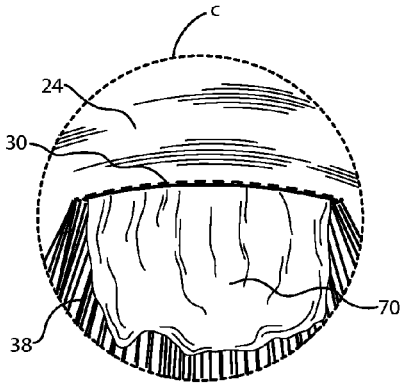
FIG. 2F.1

DIAPER RASH CREAM APPLICATOR

RELATED APPLICATIONS

This application claims the benefit of provisional patent application Ser. No. 61/278,656 filed on Oct. 13, 2009 by the present inventor, Alina Kravchenko.

FEDERALLY SPONSORED RESEARCH

Not Applicable.

SEQUENCE LISTING OR PROGRAM

Not Applicable.

BACKGROUND OF THE INVENTION

1. Field of the Invention

The present invention relates to the application of skin creams, specifically to improve the application process by eliminating certain steps to make the application process more efficient and sanitary.

2. Prior Art

The traditional method for applying skin cream is direct manual application. In particular, cream or ointment used to treat diaper rash is placed on the hands of the adult or directly on the skin of the baby and is spread about the skin of the child with the adult's hand.

Applying diaper cream usually involves about six steps. These steps are (1) pick up the diaper cream tube, (2) use one hand to hold the tube of cream and the other hand to open the top lid, (3) squeeze the cream onto either the area desired or on to the adult's fingers, and spread the cream around, (4) use one hand to hold the tube of cream and the other hand to close the top, (5) place the cream down on the changing station or store it away, (6) wipe or wash the cream off the adult's fingers.

The Problem with step (2) is that, with both hands occupied, it is challenging to secure the baby, thus creating an opportunity for the child to either fall or move about the area. The problem(s) associated with step (3) is that the adult's fingers get contaminated with the diaper rash cream, thus making it possible to stain other undesirable areas with the contaminated hand (such as clothing or the diaper area). Another problem of using fingers to spread the cream is that there is a chance of transferring bacteria from the hands of the adult to the skin of the child. In addition it is also difficult to spread the cream into the crevices, folds and creases of the baby's body, and it also becomes difficult to create an even distribution of the cream onto the skin of the child. The problem with step (5) is that if the tube of cream is placed in the changing area it opens the possibility for the child to either knock it off onto the floor or grab for it. If it is placed away, it causes this step to be more time consuming, by having to reach or look for it. The Problem with step (6) is that the waterproof components of most diaper rash creams take more effort and thus more time to wash off. Using soap and water or a wet wipe is usually necessary to get the cream fully off. Finding access to a sink while in the middle of a diaper change can be difficult, and the need to use a wet wipe will become a constant waste over time. Based on all the problems related to steps one through six the direct manual application method is undesirable.

To overcome these problems, products have been provided which include a foam pad for spreading out and applying the cream or ointment to the skin of the baby. However, even while utilizing the foam pad, cream, or ointment, problems remain. Application still requires the use of both hands. When a tube or jar of cream is left precipitously on the changing area's surface, there is always a chance that the child could grab the cream or knock if off the table. As a practical matter, such pads are typically circular and therefore do not fit in easily into the crevices, folds and creases of the baby's body.

A product that attempts to fix some of these problems is the anti-diaper rash cream from an applicator. Inventor: Goldberg; David (Marina Del Rey, Calif.) Application. No. 09/640,325 Filed: Aug. 16, 2000. Goldberg fixes some of the problems associated with the manual application method. He still leaves the problems of leaving the cream unsecured on the changing area's surface, thus creating a chance for it to fall on the floor or the child's grabbing it. Goldberg's product also requires the use of both hands to open and close the cream applicator. Furthermore, this type of dispenser is not reusable, so the user is limited to purchasing only the type of cream that comes from an applicator. In other words, after the cream from an applicator is empty, it is then thrown away and can not be reused.

SUMMARY OF THE INVENTION

Accordingly, it is a general object of the present invention to provide a method and apparatus for the application of creams that overcomes the disadvantages of the prior art.

In particular, it is an object of the present invention to provide a method of applying a diaper rash cream with the following advantages. (1) There is no need to use two hands, and as a result an adult using the product can hold a child steady. (2) It is easy to access the tube of cream in the midst of a diaper change. (3) The lid is kept securely in place while the adult is using the tube of cream, to prevent the child from grabbing or knocking it off on to the floor. (4) The adult need not touch the cream. (5) The cream does not contaminate any clothing or objects. (6) The cream is distributed evenly onto the child's skin. (7) The diaper rash cream applicator fits into the crevices, creases and folds of the child's skin. (8) It is possible to reuse the apparatus on virtually any tube of cream.

The present invention eliminates several steps from the application process and solves all the problems that are associated with the application process, by combining two parts working together. The first part is the APPLICATOR apparatus. This part is to be twisted on to a tube of cream of the proper size after the original cap has been removed. The tube is not part of the invention, but works with the invention as a handle and dispenser. It is indicated with broken lines throughout the illustrated drawings. The APPLICATOR apparatus has a hole through which the contents of the tube are squeezed. The hole is surrounded by brush bristles. This allows the user to squeeze a desired amount of cream which will come out from between the brush bristles, thus covering the bristles with the cream. Once the desired amount of cream has been squeezed from the tube, the user can continue to use the tube as a handle and swipe the desired area with the brush bristles. The shape and material of the bristles easily fits into the crevices, folds and creases of the baby's body and creates an even distribution of the cream to the child's skin, while easily keeping the adult's hands clean of the cream. These features eliminate the chance of transferring bacteria from the adult to the baby and the need to clean the adult's fingers of the cream.

The second main component of this invention is the LID. The lid consists of an open top into which the APPLICATOR is placed, and an enclosed bottom with a suction cup attached to it. The suction cup can be firmly pressed onto a flat hard surface to create a secure seal between the suction cup and the table. This keeps the LID secured onto the flat hard surface area, and leaves the open part of the LID in the upright position. The secured LID allows for the APPLICATOR to be snapped into or out of it while using only one hand. In addition, when the APPLICATOR is not in use and is placed into the LID, the suction cup seal between the lid's base and a flat hard surface will prevent the child from knocking the present invention off the changing surface area.

The combination of the APPLICATOR and the LID working together contributes to an easier, cleaner and faster way to open and close the LID and use the APPLICATOR, while using only one hand. It enables the adult to keep one hand on the child during the application process. The APPLICATOR apparatus working with the LID allows for one to reuses when the tube becomes empty, so the user is not limited to using only one type of cream. Overall, the APPLICATOR and the LID working together with any tube of cream create an easier and cleaner application process, solving all the problems of the prior art enumerated above.

BRIEF DESCRIPTION OF THE FIGURES OF THE DRAWINGS

The above mentioned features and objects of the present invention will become more apparent from the following description, taken along with the accompanying drawings where each reference numeral denote like elements and in which:

FIG. 2A is a perspective view of the APPLICATOR about to be attached to the tube. The broken lines illustrating a tube are for illustrative purposes and are not part of the claimed invention.

FIG. 2A.1 is a perspective view of the APPLICATOR with a sponge instead of brush bristles.

FIG. 2B.1 is a front elevational view of the APPLICATOR attached to a handle in place of the tube.

FIG. 2E is a perspective view of the APPLICATOR with one side of the brush bristles attached and the other side detached.

FIG. 2F is a separate close up view of the lower middle part of APPLICATOR of FIG. 2E, indicated buy the broken line c.

FIG. 2F.1 is a separate close up view of the lower middle part of APPLICATOR of FIG. 2E with the contents of the tube coming out, indicated buy the broken line c.

FIG. 2G is a bottom plan view of the APPLICATOR, without the brush bristles.

FIG. 2H is a separate close up view of the middle part of the bottom plan view of the APPLICATOR of FIG. 2G, indicated by the broken line b.

FIG. 3A is a perspective view of the LID with the suction cup bottom about to be attached onto a flat hard surface.

FIG. 3B.1 is a perspective view of the LID with the suction cup bottom sealed with the flat hard surface, with an item placed inside.

DETAILED DESCRIPTION OF THE PREFERRED EMBODIMENT

There are many variations for the present invention's many parts, ranging in various sizes, materials, shapes, and ways of working together and connecting to each other. In the following description I will be describing the preferred embodiment for the present invention. These should not limit the present invention in any way, because other sizes, shapes, materials and ways of connecting to each other, for each part are also satisfactory.

Figure 1A:
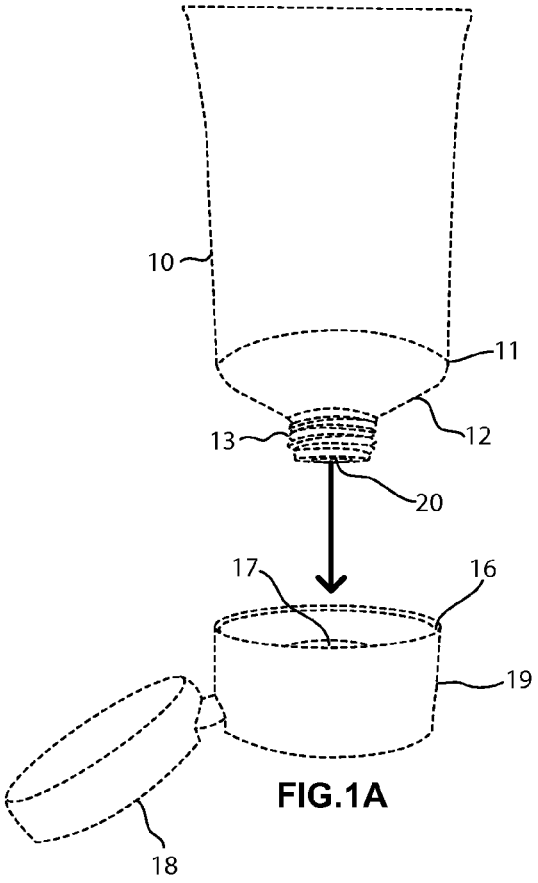
FIG. 1A is a perspective view of the tube detached from its original cap, with the lid of the cap in the open position.
Figure 1B:
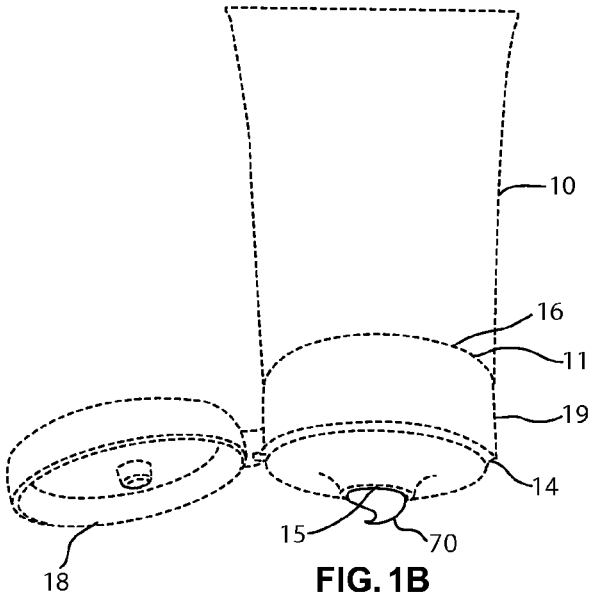
FIG. 1B is a perspective view of the tube attached to its original cap, with the lid of the cap in the open position.

First, it is essential to understand the structure and function of all the parts of the prior art, to better understand the function of the preferred embodiment of the present invention. In the case of the present invention, the prior art is the cap of a tubular structure. The cap is to be removed from the tube and replaced with the APPLICATOR part of the present invention. There are many types of various tubular structures ranging in various shapes and sizes. Accordingly, the present invention can be altered to fit the many variations of the shapes and sizes of tubular containers. In FIGS. 1A and 1B I have illustrated by broken lines a generic tube and its prior art cap and cap's lid. FIG. 1A is a perspective view of the tube detached from the prior art cap, with the lid of the cap in the open position. FIG. 1B is a perspective view of the tube attached to the prior art cap, with the lid of the cap in the open position. The top portion of the tube is the tube's body 10, indicated by a broken line. The tube's body 10 is usually made of thin bendable plastic, lightweight aluminum, or a similar material. The elongated cylindrical/tubular shape (with a closed straight top) allows for the tube's body 10 to be used as a handle. The tube's flexibility allows for a desired amount of the tube's contents such as cream 70 to come out of the tube's hole 20, depending on how much pressure is put on the tube's body 10. The lower portion of the tube is usually made up of a harder plastic or aluminum than that of tube's body 10. The components of the lower portion of the tube include: the base of tube's body 11, bottom of the tube 12, male threads 13, and tube's hole 20. The base of tube's body 11 has about the same diameter as the interior top rim 16 of the prior art cap. This is because the tube's body 11 and interior top rim 16 of the prior art cap are meant to fit with each other as seen in FIG. 1B. The bottom of the tube 12, which can be seen in FIG. 1A, typically has the same diameter as the base of tube's body 11 at the top and gradually gets narrower as it progresses downward to the diameter of the top of the male threads 13 of the tube. Inside of the middle top part of the prior art cap are the female threads 17. Both the female threads 17 and the male threads 13 can vary in many shapes and sizes in order to properly fit together by interlocking their opposite ridges, thus creating a secure seal with one another. Once the female threads 17 and the male threads 13 have been secured together, the bottom 12 of tube will fit into the hollow part of the inside of the cylindrical part of the cap's body 19. The bottom rim 15 of the prior art cap has a slight protrusion. In the center of the bottom rim 15 is a hole from which the cream 70 or similar content of the tube is dispensed. The part that is designed to cover this hole to prevent the cream 70 from spilling out is the prior art lid. This prior art lid is designed to snap in place with the cap of the prior art. This happens because the bottom rim indention 14 has a slightly smaller circular circumference than the exterior body 19 and the same circumference as the interior rim 18 of the cap's lid. This allows for the interior rim 18 of the prior art lid to fit around the bottom rim indention 14 of the prior art cap, when the lid of the prior art is placed over the cap of the prior art.

The Prior Art Cap is to be removed from the tube (usually by untwisting the male threads 13 from the female threads 17). Then the present invention's APPLICATOR is to be attached to the TUBE. Refer to FIG. 2A, which shows a perspective view of the APPLICATOR about to be attached to the TUBE. The broken lines illustrating a TUBE are for illustrative purposes and are not a claimed part of the invention. FIG. 2A shows that the inside surface 34 is the inverse shape of the bottom 12 of the tube and also that the top rim 33 of the applicator and the base of tube's body 11 mirror each other. This is because the inside surface 34 and the bottom of tube 12 are meant to fit with one another and the top rim of applicator 33 is supposed to be pressed against the base of tube's body 11. These connections are seen better by referring to FIG. 2D, which illustrates a perspective cross sectional view taken along line 2C-2C of the APPLICATOR attached to a TUBE of FIG. 2C. In FIG. 2D it is especially clear how the bottom 12 of the tube becomes flush with the inside surface 34 of the APPLICATOR.

Figure 2B:
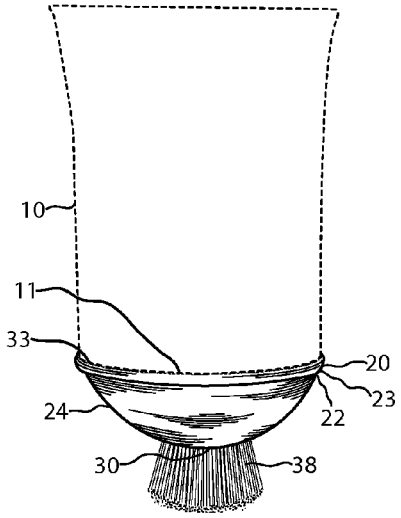
FIG. 2B is a front elevational view of the APPLICATOR (which is attached to a tube). The broken lines illustrating a tube are for illustrative purposes and are not part of the claimed invention.
Figure 2C:
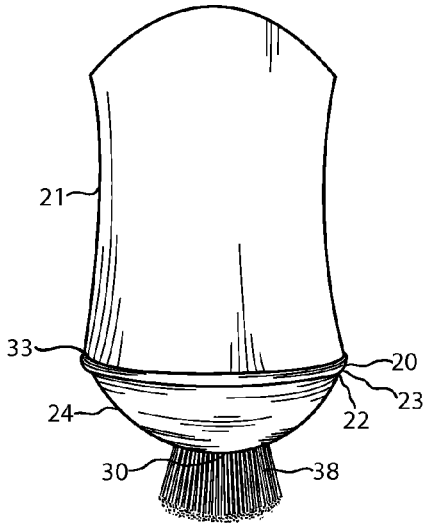
FIG. 2C is a side elevational view of the APPLICATOR (which is attached to a tube).
Figure 2C:
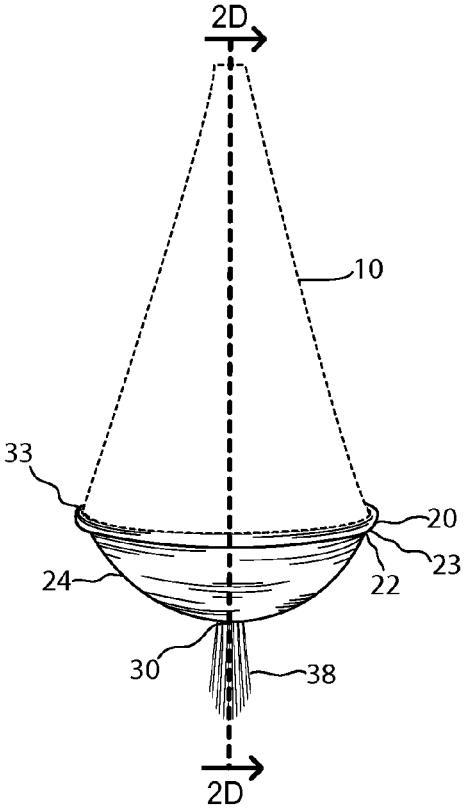
Figure 2D:
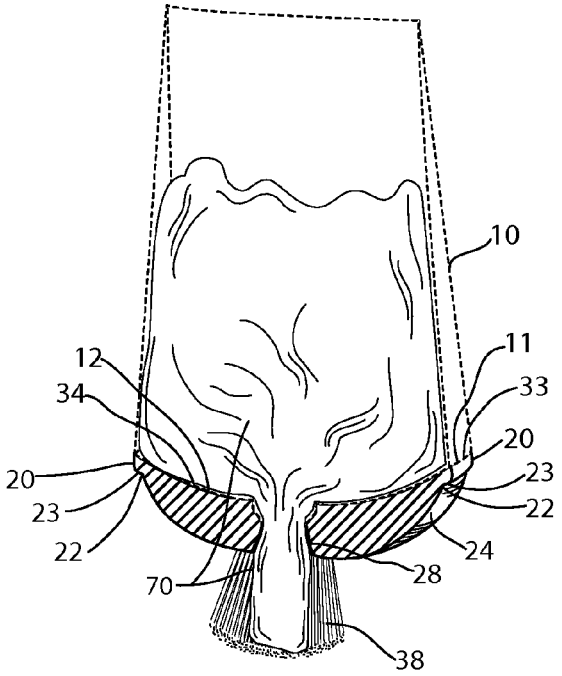
FIG. 2D is a cross sectional view taken along line 2D-2D of the APPLICATOR (which is attached to a tube) of FIG. 2C
Figure 2L:
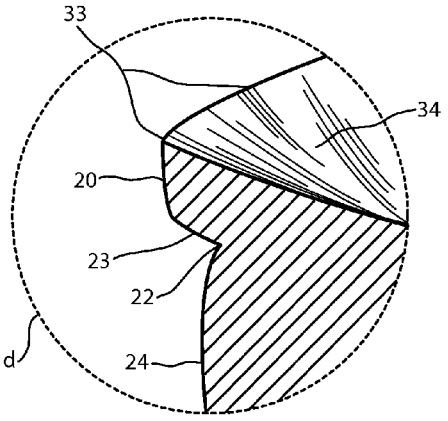
FIG. 2L is a separate close up view of the top left part of the cross sectional view of the APPLICATOR of FIG. 2J, indicated buy the broken line d.
Figure 2M:
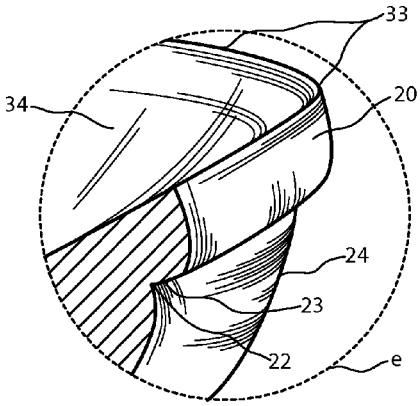
FIG. 2M is a separate close up view of the top right part of the cross sectional view of the APPLICATOR of FIG. 2J, indicated buy the broken line e.
Figure 2I:
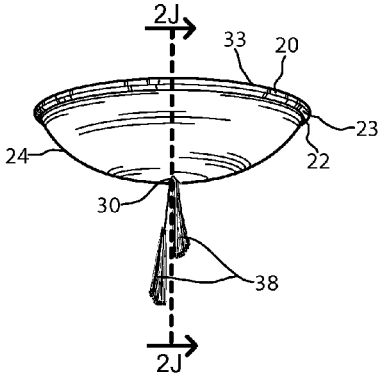
FIG. 2I is a perspective view of the APPLICATOR with one side of the brush bristles about to be attached to the APPLICATOR of FIG. 2E.
Figure 2J:
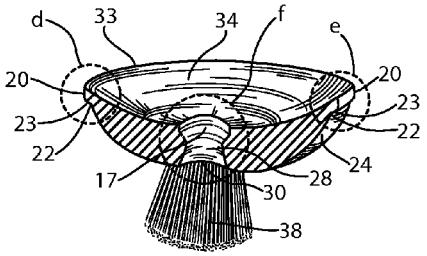
FIG. 2J is a perspective cross sectional view taken along line 2J-2J of the APPLICATOR of FIG. 2I

To better understand how the bottom portion of the tube interlocks and is able to stay in place with the APPLICATOR, refer to FIG. 2J, which shows a perspective cross sectional view taken along line 2J-2J of the APPLICATOR of FIG. 2I. Keep in mind that FIG. 2J only shows half of the symmetric APPLICATOR. FIG. 2J also depicts the shape and size of the inside surface 34 of the APPLICATOR, which starts out wider at the top where it meets with the top rim 33 of APPLICATOR and gets narrower as it progresses downward towards the top of the female threads 17 of the applicator. Although the inside surface 34 of the APPLICATOR can be more spacious, in the preferred embodiment, it fits snugly against the bottom 12 of the tube when the male threads 13 of the tube are twisted in place with the female threads 17 of the APPLICATOR.

Figure 3B:
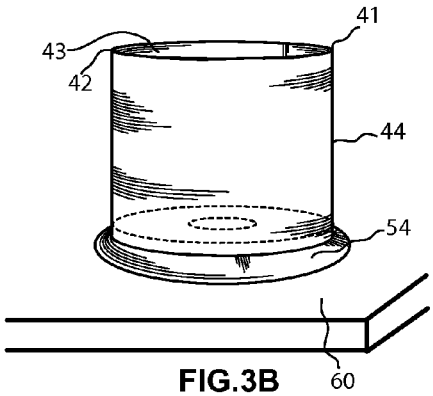
FIG. 3B is a perspective view of the LID with the suction cup bottom sealed with the flat hard surface.
Figure 3C:
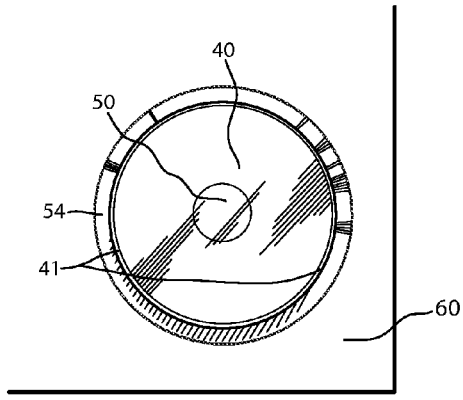
FIG. 3C is a top plan view of the LID with a suction cup bottom sealed to a flat hard surface of FIG. 3B.

FIG. 2B shows a front elevational view of the APPLICATOR attached to the TUBE. This figure shows how the top rim 33 of the APPLICATOR and base of tube's body 11 fit snugly together. The broken lines illustrating a TUBE are for illustrative purposes and are not the invention. There are many shapes that the APPLICATOR (and its LID) can take. The rim 33 of the APPLICATOR goes all the way around the very top exterior of the APPLICATOR and fits the base of tube's body 11. For purposes of the illustrations, the rim 33 of the APPLICATOR is depicted as circular. FIG. 2G illustrates a bottom plan view of the APPLICATOR, (only without the brush bristles). FIG. 3C is a top plan view of the LID with a suction cup bottom sealed to a flat hard surface of FIG. 3B.

Figure 2K:
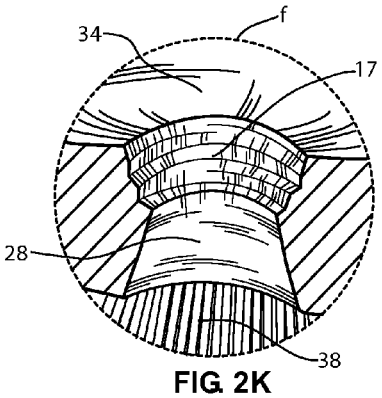
FIG. 2K is a separate close up view of the bottom middle part of the perspective cross sectional view of the APPLICATOR of FIG. 2J, indicated buy the broken line f.

FIG. 2K shows a separate close up view of the bottom middle part of the perspective cross sectional view of the APPLICATOR of FIG. 2J, indicated by circular broken line f. Keep in mind that because FIG. 2K is a close up cross sectional view of the APPLICATOR, the illustration only shows one half of the interior including the inside surface 34, female threads 17 and the hole interior rim 28 of the APPLICATOR, and that the other half of the APPLICATOR looks the same as the one illustrated in FIG. 2K. The size and shape of the female threads 17 can vary depending on the size of the male threads 13 of the tube. The preferred embodiment of the APPLICATOR part of the invention has female threads 17 that are shaped to fit with the male threads 13 of commonly available tubes. Like most female threads, the generic ones illustrated here have circular shaped ridges. The male threads 13 with opposite circular ridges are to be twisted in place with the frame threads 17, and as a result of interlocking their opposite circular ridges create a tight and secure seal with one another.

Below the female threads 17 of the APPLICATOR is the hole tunnel 28 of the APPLICATOR. The very top of the hole tunnel 28 of the APPLICATOR has the same shape and size as the bottom part of the female threads 17, and the hole tunnel 28 gradually gets wider as it progresses down to meet with the size and shape of the hole rim 30 of the APPLICATOR. This hole tunnel 28 can take many shapes and sizes and even be eliminated from the APPLICATOR altogether. The hole rim 30 of the applicator can assume any reasonable shape such as round, oval, square, or rectangular. In the preferred embodiment I have added the hole tunnel 28 because the very narrow almond-like shape that the hole tunnel 28 creates toward the bottom of the APPLICATOR will allow both sides of the brush bristles 38 to be flush with one another when they are attached to the hole rim 30 of the APPLICATOR. Refer to FIG. 2I to see a side perspective view of the APPLICATOR with one side of the brush bristles 38 about to be attached to the hole rim 30 of the APPLICATOR. Once the brush bristles 38 have been attached to the hole rim 30 of the APPLICATOR, refer to FIG. 2C, which illustrates a side perspective view of the APPLICATOR attached to a TUBE. Both sides of the brush bristles 38 lie flat with each other (and are wide at the other side) because of the very narrow shape of the hole rim 30 at one side and wide shape at the other. When the cream 70 is pushed through the hole rim 30 of the APPLICATOR the very narrow almond shape of the hole rim 30 will allow for the cream 70 to come out from between the brush bristles 38 in a flat sheet. This is shown in FIG. 2D, a perspective cross sectional view taken along line 2D-2D of the APPLICATOR attached to a TUBE of FIG. 2C.

In order to better see the very narrow almond like shape of the bottom of the hole tunnel 28 and the hole rim 30 of the APPLICATOR, I have illustrated a bottom plan view of the APPLICATOR with the brush bristles 38 removed. Refer to FIG. 2G. The broken line going around the middle of the bottom plan view of FIG. 2G of the applicator is indicated by the letter b, and is blown up in a separate close up view and is labeled as FIG. 2H. In FIG. 2H you can better see the very narrow almond shape (with pointy ends) at the base of the hole tunnel 28. Around the hole tunnel 28 is the hole rim 30 of the APPLICATOR and it is represented by broken lines indicating where the brush bristles 38 are to be placed. Although there a number of ways in which the brush bristles 38 can be attached to the APPLICATOR, placing the brush bristles 38 around the hole rim 30 of the APPLICATOR will provide the most efficient application process.

Refer to FIG. 2E, which is a straight perspective view of the APPLICATOR with one side of the brush bristles attached and the other side detached. The reason why one side of the brush bristles 38 have been removed from one side of the hole rim 30, is to better illustrate how the brush bristles 38 attach to the hole rim 30 and to show the very narrow almond like shape of the hole rim 30 of the APPLICATOR. Take a look at the circular broken line c indicating the lower middle of the applicator with one side of the brush bristles removed, taken from FIG. 2E and blown up in a separate labeled FIG. 2F. FIG. 2F shows a little bit of the bottom part of the hole tunnel 28 and especially the way the hole rim 30 surrounds the bottom part of the hole tunnel 28 of the APPLICATOR. In order to better see the shape that cream 70 takes, refer to FIG. 2F.1. The narrow, elongated shape of the hole rim 30 allows the cream 70 to be dispensed in a flat sheet, as mentioned before.

There are various types of materials that could be placed around the hole rim 30 of the APPLICATOR, and the present invention could still fix all of the problems that are associated with the prior art. For example, a sponge like material can take place of the brush bristles 38 and be placed in any manner around the hole rim 30 of the APPLICATOR. You can see the sponge 39 in place of the brush bristles 38 by referring to FIG. 2A.1 which is a straight perspective view of the APPLICATOR with a sponge bottom. There is no limit to what can take place of the brush bristles, so long that whatever the object is; it is capable of being used to apply a desired amount of cream 70 (or any other preferred content) onto any desired surface area. If brush bristles 38 are used, the range in the types of bristles can also vary from natural hairs to synthetic fibers, such as silicone, rubber, plastic and the likes. In the preferred embodiment I feel that there is more of a benefit if the brush bristles 38 are made out of soft synthetic fiber bristles. This is because unlike the sponge which will absorb the cream 70, the synthetic fiber bristles will not. Another benefit is that most synthetic fibers bristles are generally soft and silky to the touch and relatively inexpensive compared to other types of bristles, such as animal hairs. In addition, the synthetic fiber bristles of the brush bristles 38 will also allow an even distribution of the cream 70 when swiped on the desired surface.

In order to understand how and where the brush bristles 38 are to be attached to the hole rim 30 of the APPLICATOR take a look at FIG. 2E and FIG. 2I which show different perspective views of the APPLICATOR with one side of the brush bristles about to be attached to the APPLICATOR. There are many ways in which the brush bristles 38 can be attached to the APPLICATOR. In the preferred embodiment, the top portion of the brush bristles 38 is positioned around the hole rim 30 of the APPLICATOR while the material of the APPLICATOR is still in liquid form. Note that all of the various parts of the APPLICATOR could be made out of most sturdy materials such as wood, light weight metals (like aluminum), and plastic. Plastic is the most desirable material, because most plastics are relatively cheaper to reproduce then other materials. In addition most plastics start off being in a liquid state. This liquid state allows the liquid plastic to be poured in a desired mold, such as the mold of the APPLICATOR. Then when the plastic hardens it takes the shape of its mold. This liquid state allows for the top portion of the brush bristles 38 to be placed into the hole rim 30 of the APPLICATOR. The plastic (while in liquid form) will surround the space between the individual brush bristles 38 and when the plastic material hardens it will act like a seal securing the brush bristles 38 in place with the hole rim 30 of the APPLICATOR. A glue could be placed in between the top portion of the brush bristles 38 where they meet with the hole rim 30 of the APPLICATOR, to ensure an even and more secure attachment.

Once the brush bristles 38 have been secured around the hole rim 30 of the APPLICATOR, the brush bristles 38 will assume the shape of the hole rim 30 of the APPLICATOR. In the side view of the APPLICATOR shown in FIG. 2C, you can see the brush bristles 38 are narrow and in the straight perspective view of the APPLICATOR shown in FIG. 2B, you can see that the brush bristles 38 are wide. Once the brush bristles 38 have been secured around the hole rim 30 of the applicator, the bottom of the brush bristles 38 could be trimmed into a rounded shape as seen in both FIG. 2A and FIG. 2B. In both of these figures you can see the outer exterior 24 of the applicator, which has a dome like shape that is smallest in circumference where it meets with the hole rim 30 of the applicator and largest in circumference where it meets with the inner corner indention 22 of the APPLICATOR.

There are many ways in which the APPLICATOR and the LID can be attached and detached. In the preferred embodiment they are snapped together, thus creating an air-tight seal in order to prevent contaminating the brush bristles 38 of the APPLICATOR, when the APPLICATOR is not in use. In order to better understand how this is possible, first look at all the parts of the top portion rim of the APPLICATOR. Refer to FIG. 2L (which is indicated by a broken line d) and 2M (which is indicated by a broken line e) which show separate close up views of the top left and right sides of the perspective cross sectional view of the APPLICATOR of FIG. 2J. Although you can only see the right and left of the APPLICATOR, keep in mind that all the parts and the connections go all the way around the entire perimeter of both the APPLICATOR. In FIGS. 2L and 2M you can see the inner corner indention 22 of the applicator; this is the corner where the bottom rim 23 and the outer exterior 24 of applicator meet. The circumference of the inner corner indention 22 of the applicator is circular, which is slightly smaller in size then the top part (or the largest circumference size part) of the outer exterior 24 of applicator. The result of the smaller circumference of the inner corner indention 22 compared to the outer exterior 24 of applicator, creates an indention between the bottom rim 23 of applicator and the outer exterior 24 of applicator. The inner corner indention 22 of applicator has the same circumference as the tip of the lip interior 42 of the lid. This is because both parts are meant to fit together when the APPLICATOR is attached to the LID. The top rim 41 of the lid acts as a support for the bottom rim 23 of applicator to sit on. The size and shape of the bottom rim 23 of the applicator can range; in the preferred embodiment the bottom rim 23 of applicator is in the shape and size that mimics the top rim 41 of the lid. This is because both parts are designed to become flush with one another when the APPLICATOR is attached to the LID.

Figure 3G:
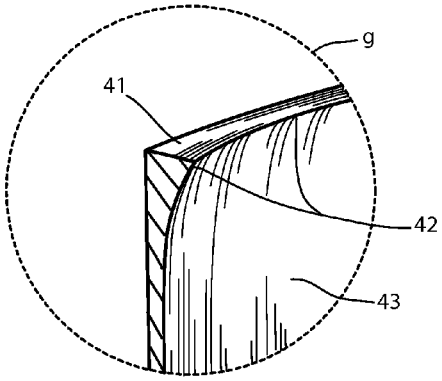
FIG. 3G is a separate close up view of the left side of the cross sectional view of the LID with a suction cup bottom of FIG. 3F, indicated buy the broken line g.
Figure 3H:
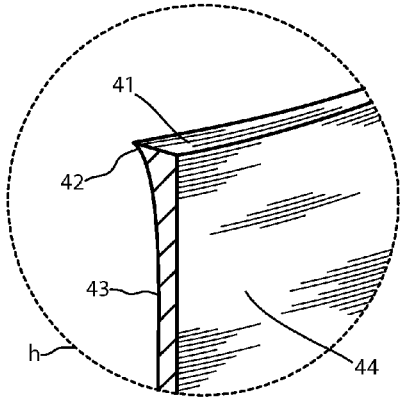
FIG. 3H is a separate close up view of the right side of the cross sectional view of the LID with a suction cup bottom of FIG. 3F, indicated buy the broken line h.

Now look at all the parts of the LID that are to be attached to the APPLICATOR. Refer to FIG. 3G (which is indicated by a broken line g) and FIG. 3H (which is indicated by a broken line h), which are separate close up views of the right side and left side of the LID with a suction cup bottom of FIG. 3F. Although you can only see the right and left of the APPLICATOR attached to the LID, keep in mind that all the parts and the connections of the LID go all the way around the entire perimeter of the LID. In FIGS. 3G and 3H you can see the top rim 41 of the lid, which has a similar sized circular circumference as the bottom rim 23 of the applicator; as I mentioned before this is because 23 bottom rim of applicator sits on top of 41 top rim of the LID. Toward the very top of the inner interior 43 of the lid, right below the top rim 41 of the lid, is the lip 42 interior of the lid. The very top of the lip interior 42 of the lid has the same circular shape and sized circumference as the inner corner indention 22 of the applicator, (This is because both of these parts are meant to snugly fit together, as I mentioned before.) As the lip interior 42 of the lid progresses downwards the circumference of it gets slightly wider to meet with the inner interior 43 of the lid. The inner interior 43 of the lid is about the same size in circumference as the widest part of (which is the top part) of the outer exterior 24 of the applicator.

Figure 4A:
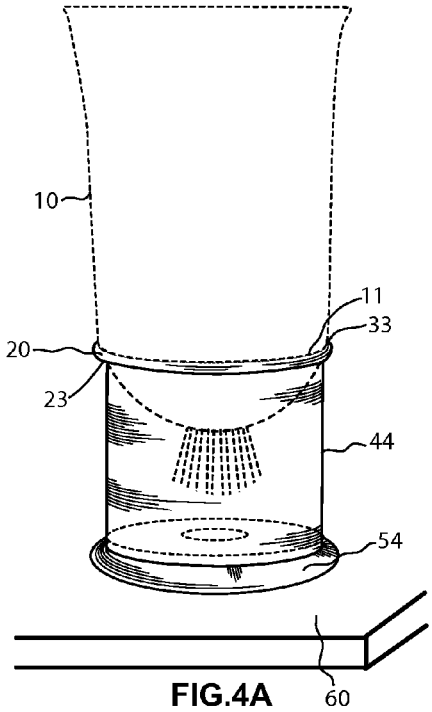
FIG. 4A is a perspective view of the APPLICATOR (which is attached to a tube) placed into the LID with the suction cup bottom attached onto a flat hard surface. The broken lines illustrating a TUBE are for illustrative purposes.
Figure 4E:
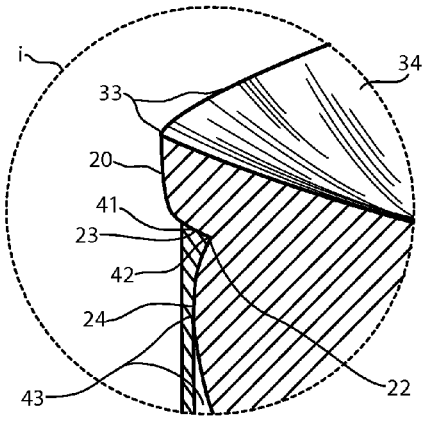
FIG. 4E is a separate close up view of the left side of the APPLICATOR attached to the LID of FIG. 4C, indicated by the broken line i.
Figure 4F:
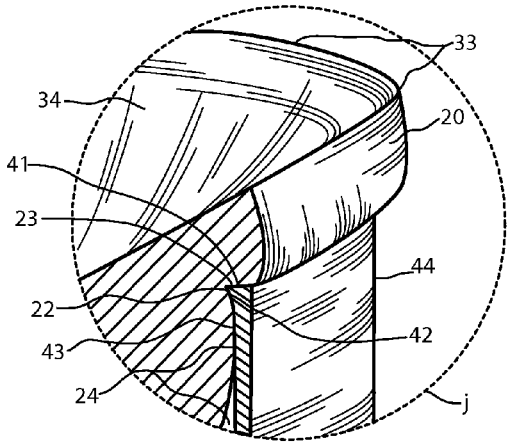
FIG. 4F is a separate close up view of the right side of the APPLICATOR attached to the LID of FIG. 4C, indicated by the broken line i.
Figure 4B:
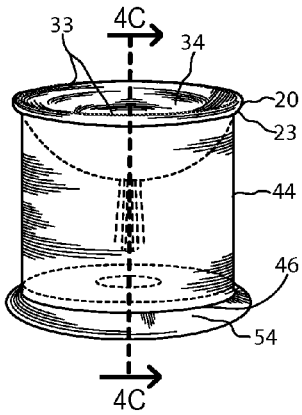
FIG. 4B is a perspective view of the APPLICATOR attached to the LID (with a suction cup bottom).
Figure 4C:
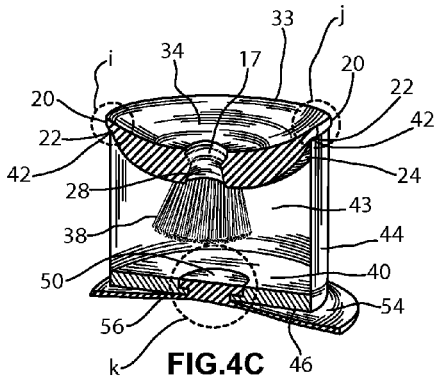
FIG. 4C is a perspective cross sectional view taken along line 4C-4C of the APPLICATOR attached to the LID of FIG. 4B

The dome shape of the outer exterior 24 of the applicator allows for the LID to fit over the APPLICATOR easily. In addition, the flexible plastic material of which the LID is made (in the preferred embodiment) allows for the top portion of the LID to be slightly flexible; Thus allowing the lip interior 42 of the lid to slide over the outer exterior 24 of applicator and as a result get locked in place within the inner corner indention 22 and the bottom rim 23 of applicator. In order to better see and understand how the LID is snapped onto the APPLICATOR, I have cut FIG. 4B (which is a side perspective view of the APPLICATOR attached to the LID) down the middle and I have illustrated the right half in FIG. 4C. Then I have illustrated separate close up views of the left and right sides of the top parts of the APPLICATOR attached to the LID/STAND of FIG. 4C, represented by FIG. 4E (which is indicated by broken line i) and FIG. 4F (which is indicated by broken line j). Although you can only see the right and left of the APPLICATOR attached to the LID, keep in mind that all the parts and the connections between the APPLICATOR and LID go all the way around the entire perimeter of both the APPLICATOR and the LID. In FIG. 4E and FIG. 4F, you can see how all the parts of the top part of the APPLICATOR fit with the top portion of the LID. At the top of the junction is the bottom rim 23 of applicator, which becomes flush with and sits on top of the top rim 41 of the lid. Next, the lip interior 42 of the lid and the inner corner indention 22 of the applicator become flush with one another, because they both have the same sized circular circumferences. As I have mentioned previously, the shape of the lip interior 42 of the lid is a reflection of the inner interior 43 of lid, with the lip interior 42 of the lid projecting out and gradually getting narrower to meet with the smaller circular circumference of the inner interior 43 of the lid. In FIG. 4E and FIG. 4F, you can also see how the inner corner indention 22 of the applicator meets with the outer exterior 24 of the applicator, because the inner corner indention 22 of the applicator is projecting in and gradually wider to meet with the larger circular circumference of the top part of the outer exterior 24 of the applicator. The result of this allows for the lip interior 42 of the lid and the top portion of the inner interior 43 of the lid to become flush with the inner corner indention 22 of the applicator and the top part of the outer exterior 24 of applicator. Above this connection is the top rim exterior 20 of the applicator, which at the bottom has a circular circumference that is the same as the widest part of the bottom rim 23 of the applicator and gradually gets slightly wider in circumference towards the top, where it meets with the top rim 33 of the applicator.

Figure 3E:
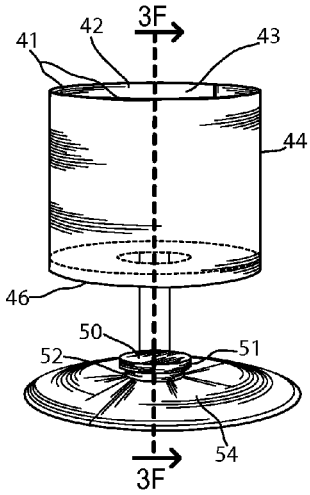
FIG. 3E is a perspective view of the LID with a suction cup bottom detached from the lids base.

Now that we understand all the parts of the APPLICATOR and how they attach to the LID, let's take a look at the rest of the parts of the LID in order to better understand its function as a lid and as a stand. Refer to FIG. 3E, which shows a perspective view of the LID with a suction cup bottom detached. Here you can see that below the top rim 41 of the lid is the outer exterior 44 of the lid, the shape and size of which can take many forms. In the preferred embodiment, the outer exterior 44 is in a cylinder shape which is wide and long enough to fit the outer exterior 24 of the applicator and the brush bristles 38 of the applicator inside of it. In other words, the length and size of the outer exterior 44 of the lid can vary depending on the size of the entire APPLICATOR and the length of the brush bristles 38 of the applicator. The thickness between 43 inner interior of lid and 44 outer exterior of lid can vary, but should it be thick enough to create a sturdy frame between 41 top rim of lid and the entire base of the LID, mainly to prevent it from collapsing when the APPLICATOR is attached and detached to and from the LID.

Figure 3F:
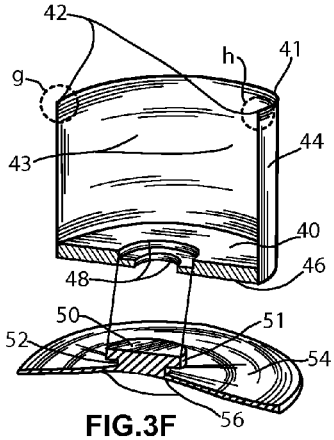
FIG. 3F is a perspective cross sectional view taken along line 3F-3F of the LID with a suction cup bottom detached of FIG. 3E.
Figure 3D:
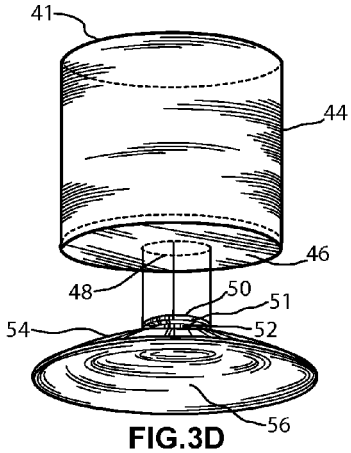
FIG. 3D is a perspective view of the LID with a suction cup bottom detached from the lid's base.

Take a look at FIG. 3D which shows a slight bottom perspective view of the LID with a suction cup bottom detached from the lid's base. Here you can see that the bottom part of the outer exterior 44 of the lid is connected to the base exterior 46 of the lid. The perimeter of the base exterior 46 of the lid could range in size and shape. In the preferred embodiment it is recommended that the circular circumference of the base exterior 46 of the lid is to be about the same as the outer perimeter of the top rim 41 of the lid, or wider. (The main reason for this is because it will create a sturdier base for when the suction cup is secured onto a flat hard surface, as I will later describe). Keep in mind that the circumference and shape of the outer exterior 44 of the lid can vary and change depending on the circumference size and shape of the top rim 41 of the lid and the base exterior 46 of the lid. In FIG. 3D you can see in the center of the base exterior 46 of the lid are broken lines indicating the suction cup placement 48. The suction cup is not part of the claimed invention, but it works with the present invention to secure the base of the LID to any desired flat hard surface 60 that is large enough to create an air tight seal with the suction cup. It is preferred that the suction cup is large enough to support the LID and the APPLICATOR that is attached to the tube. The suction cup should be wide enough to prevent the APPLICATOR from falling over. In the preferred embodiment, I will be describing the most generic type of suction cup, although this will not limit my invention to that particular kind. Like in the generic type of suction cup, the one used with the present invention is made up of a flexible rubbery material, made to create a tight seal with 60 flat hard surface. In addition, the suction cup that I have illustrated has a slightly larger circumference then the base exterior 46 of the lid. You can refer to FIG. 4B, which shows a side perspective view of the APPLICATOR attached to the LID. Note how the widest circumference of the outer exterior 54 of the suction cup is wider than the base exterior 46 of the lid.

Refer to FIG. 3E, a perspective view of the LID with a suction cup bottom detached, and FIG. 3D, which is a slight bottom perspective view of the LID with a suction cup bottom detached from the lid's base. In both FIG. 3E and FIG. 3D, you can see all the parts of the suction cup. The top 50 of the suction cup is the very top of the suction cup. It has a circular circumference and a flat top. Below the top 50 of the suction cup is the top rim 51 of the suction cup, which has the same sized circular circumference as the top 50 of the suction cup. The top rim 51 of the suction cup is connected to the middle rim 52 of the suction cup. The middle rim 52 of the suction cup has a slightly smaller circular circumference than that of both the top 50 and the top rim 51 of the suction cup. The base of the middle rim 52 of the suction cup is connected to the outer exterior 54 of the suction cup. The shape of the outer exterior 54 of the suction cup is a very flat dome, which starts out having the same circular circumference as the bottom part of the middle rim 52 of the suction cup, and gradually gets wider in circumference to meet with the outer circular perimeter of the bottom 56 of the suction cup. In FIG. 3D you can see the bottom 56 of the suction cup, which is in a hollow dome like shape. The bottom 56 of the suction cup is designed to be pressed onto a flat hard surface, which will allow for the flexible rubber like material (in which most suctions cups are made from) to expand and create an air tight seal with any flat hard surface that is large enough to cover the perimeter of the widest part of the suction cup.

Figure 4D:
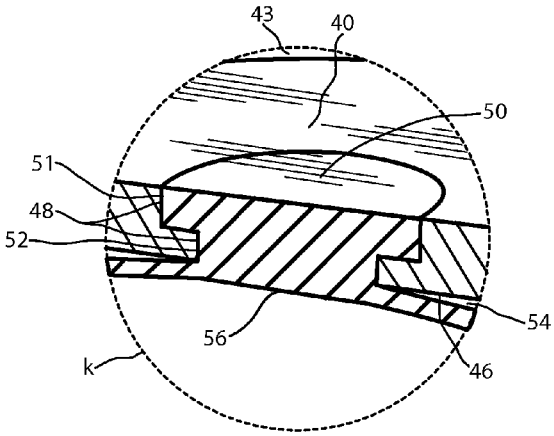
FIG. 4D is a separate close up view of the bottom middle part of the LID of FIG. 4C, indicated by the broken line k.

There are many ways in which the suction cup can be attached to the LID, and there is no particular way that limits the invention. In the preferred embodiment in order to better understand how the suction cup is attached to LID, take a look at FIG. 3F which illustrates a perspective cross sectional view taken along line 3F-3F of the LID with a suction cup bottom detached, of FIG. 3E. Keep in mind that FIG. 3F shows half of the LID and half of the suction cup, and that the other half looks the same. In FIG. 3F you can see how the bottom part of the inner interior 43 of the lid is connected to the base interior 40 of the lid; and as a result the base interior 40 of the lid has a circular circumference similar to that of the inner interior 43 of the lid. The thickness between the base exterior 46 and base interior 40 of the lid can vary, but it is typically similar to the distance from the top 50 of the suction cup to the bottom part of the middle rim 52 of the suction cup. In the center of the base interior 40 and the base exterior 46 of lid, is the suction cup placement 48, the shape of which is mirrored after the top rim 51 and the middle rim 52 of the suction cup parts. The suction cup placement 48 gets its shape during the mold making process; while the plastic material of the LID is still in liquid form, the entire top part of the suction part including the top 50, top rim 51 and the middle rim 52 of suction cup are to be placed into the middle bottom part of the LID. After the top portion of the suction cup has been placed into the bottom of the LID (while the plastic in which the LID is made of is still in liquid form) the plastic will fit into all of the crevices of the entire top part of the suction cup, and as a result create a tight and secure seal once the plastic hardens. In order to see this take a look at FIG. 4C which shows a perspective cross sectional view taken along line 4C-4C of the APPLICATOR attached to the LID of FIG. 4B. Pay close attention to how the suction cup is attached to the bottom of the LID by referring to FIG. 4D (indicated by the broken line k), which illustrates a separate close up view of the bottom middle part of the LID of FIG. 4C. In FIG. 4D you can see that the middle rim 52 of the suction cup has a smaller circumference then that of the top 50 and the top rim 51 of suction cup, and as a result when the plastic material surrounds the middle rim 52 of the suction cup it will keep the suction cup in place when the plastic material (in which the LID is made of) hardens. In FIG. 4D you can also see how the top 50 surface or the suction cup becomes flush with the base interior 40 of the lid.

After the suction cup has been securely attached to the base of the LID, the suction cup is ready to be attached onto a flat hard surface 60. Take a look at FIG. 3A, which illustrates a slight bottom perspective view of the LID with the suction cup bottom about to be attached to a flat hard surface. You can see the end result of the suction cup attachment onto a flat hard surface by referring to FIG. 3B which illustrates a straight perspective view of the LID with the suction cup bottom sealed with the flat hard surface 60. Here you can see the opening of the LID, which is designed to place the APPLICATOR into. You can see right above FIG. 3B, is FIG. 2B which is a straight perspective view of the APPLICATOR about to be attached to the TUBE. After the APPLICATOR (that is attached to a tube) has been snapped in place with the LID you can refer to FIG. 4A. Here you can see a straight perspective view of the APPLICATOR (that is attached to a tube) and snapped in placed with the LID with the suction cup bottom that is secured onto a flat hard surface 60. (The broken lines illustrating a tube are for illustrative purposes, to indicate the tube.) This results in the tube being in the upright position, which allows easy and fast access.

There are many alternative ways in which the APPLICATOR of the present invention can be attached and detached to and from the LID of the present invention. In addition there are many variations that both the APPLICATOR and the LID can take shape and size of. Aside from the one I mentioned in the preferred embodiment, another one is illustrated in FIGS. 5A, 5B, 5C and 5D. Take a look at FIG. 5C which shows a slight top perspective view of another version of the APPLICATOR. In FIG. 5C, you can see the interior 71 of the APPLICATOR, which is hollow in this version of the APPLICATOR. This hollow interior 71 of the APPLICATOR is to fit over and cover the bottom of the TUBE 12, when the male threads 13 of the TUBE are twisted in place with the female threads 17 of the APPLICATOR. As I have mentioned before, the top rim 33 of the APPLICATOR can vary in many sizes to accommodate a proper fit with the base of tube's body 11. You can see how the top rim 33 of the APPLICATOR fits snugly together with the base of tube's body 11, when the TUBE is attached to the APPLICATOR in FIG. 5D.

Figure 5A:
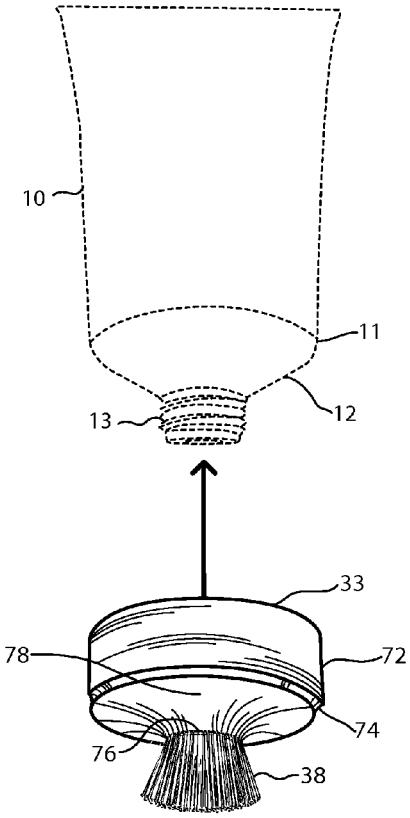
FIG. 5A is a perspective view of another version of the APPLICATOR about to be attached to the tube. The dashed lines illustrating a tube are not part of the invention.
Figure 5D:
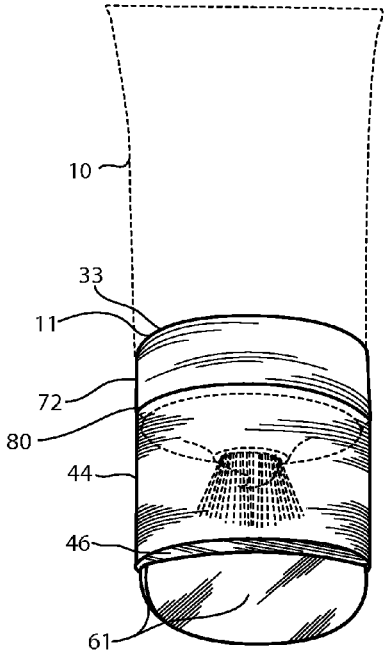
FIG. 5D is a perspective view of the APPLICATOR (which is attached to a tube, illustrated by the broken line) snapped in place into the LID (with pull tab bottom).
Figure 5B:
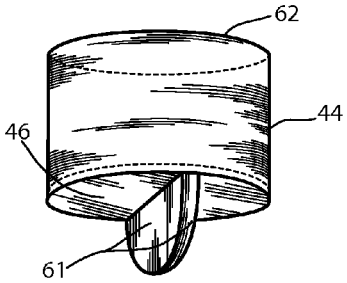
FIG. 5B is a perspective view of an alternate version of the LID, with a pull tab bottom instead of a suction cup bottom.
Figure 5C:
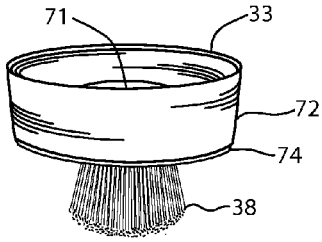
FIG. 5C is a perspective view of an alternate version of the APPLICATOR.

Refer to FIG. 5A which shows a slight bottom perspective view of another version of the APPLICATOR about to be attached to the TUBE. FIG. 5B is a side perspective view of another version of the LID, with a pull tab instead of a suction cup bottom. The attachment between the APPLICATOR and the LID is possible as a result of the exterior indention 74 of the APPLICATOR having a slightly smaller circular sized circumference then that of the interior rim 62 of the LID. That way when the LID is placed over the APPLICATOR, the indention 74 of the APPLICATOR will cover and snap in place with the interior rim 62 of the LID. Since the base of the exterior 72 of the APPLICATOR is larger in circumference than both the indention 74 of the APPLICATOR and the interior rim 62 of the LID, the base of the exterior 72 of the LID acts like a barrier in keeping the LID of the present invention in place with the APPLICATOR apparatus of the present invention. Furthermore, since the exterior circumference of the exterior 72 (of another version of the applicator) is the same size circumference as the exterior circumference as 44, this will allow for the exterior 72 of the APPLICATOR and for the outer exterior 44 of the LID to become flush with one another. In order to see the result of the LID being attached onto the APPLICATOR look at FIG. 5D which shows a straight perspective view of the TUBE attached to the APPLICATOR attached to the LID with pull tab.

The key role of the present invention's LID is to allow a human to attach and detach the LID to and from the APPLICATOR while using one hand. Another way of allowing a human to attach and detach the LID to and from the APPLICATOR is by placing a pull tab 61 at the base of the LID, in place of the suction cup. Take a look at FIG. 5B, a side perspective view of another version of the LID, with a pull tab instead of a suction cup bottom. FIG. 5D is a straight perspective view of the TUBE attached to the APPLICATOR attached to the LID with pull tab. You can see that the pull tab 61 is narrow from the side perspective view of FIG. 5B and wide from the straight perspective view as seen in FIG. 5D. The shape, size and material of the pull tab 61 can take many alternatives. In the preferred embodiment I feel that it is best if it is made out of a flexible rubber like material, in the shape of a semi-circular disk, with thick enough sides to keep its shape without being flimsy. The reason why a flexible rubber material is preferred is because it will be comfortable and easy to pull the tab with the mouth or hand. There are several ways that the pull tab can be attached to the LID, for example the top portion of the pull tab 61 could be glued onto the base of the LID. Another example is if both the LID and the pull tab 61 were made out of the same material, and the pull tab 61 will automatically become part of the LID during the mold making process. In the preferred embodiment the top portion of the pull tab 61 is pressed into the base of the LID, during the mold making process, similarly to how the suction cup is attached to the base of the LID. That is, when the plastic material of the LID is still in a liquid state, the top portion of the pull tab 61 is to be placed into the LID's base, so when the plastic material hardens, the top portion of the pull tab 61 will remain locked inside of the hardened plastic.

Figure 6A:
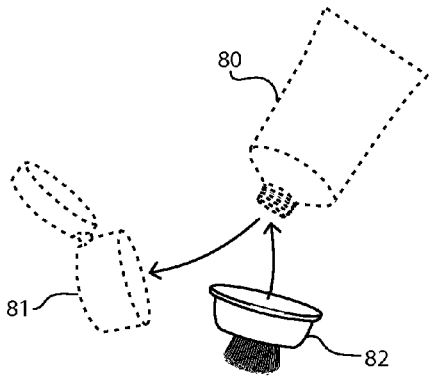
FIG. 6A is an illustration of step one of assembling the APPLICATOR, removal of the original cap from the tube and attachment of the APPLICATOR of the present invention onto the tube.
Figure 6B:
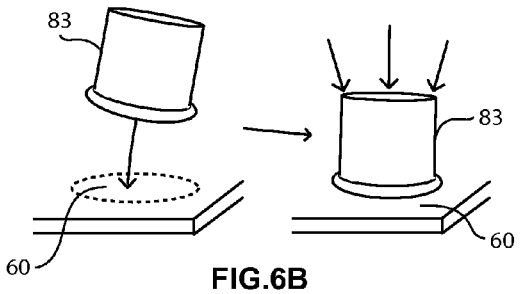
FIG. 6B is an illustration of step two of assembling the LID (with the suction cup bottom), securing the suction cup onto a flat hard surface and pressing down on the LID to create a tight seal with the flat hard surface.
Figure 6C:
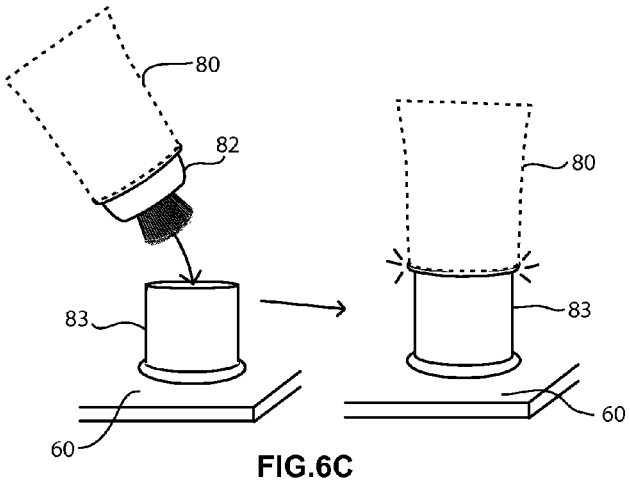
FIG. 6C is an illustration of step three of assembling the APPLICATOR and LID (with the suction cup bottom), snapping the APPLICATOR into the open end of the LID.

Now that we have an idea of the APPLICATOR's apparatus and the LID's physical structure and elements, let me explain how to assemble them. Take a look at FIGS. 6A, 6B and 6C, where steps one through three are illustrated in each figure. Begin with FIG. 6A showing step (1) Remove the prior art cap 81 (illustrated by a broken line) from the tube 80 (illustrated by a broken line) and twist the applicator 82 on to the tube 80. Step (2) is illustrated in FIG. 6B: Place the LID 83 with a suction cup bottom on to a flat hard surface 60 and press down firmly, to ensure a tight seal with the suction cup bottom and the flat hard surface 60. The final step (3) is illustrated by FIG. 6C. Use the tube 80 as a handle and snap the APPLICATOR 82 into the LID 83 with a suction cup bottom. The present invention is designed to be reused, so when the tube 80 becomes empty, simply follow steps one through three illustrated by FIGS. 6A, 6B and 6C in order to replace the empty tube 80.

Figure 7A:
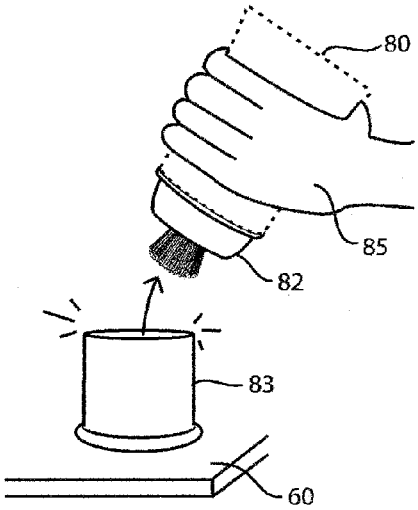
FIG. 7A is an illustration of step one of using the APPLICATOR and LID (with the suction cup bottom), pulling the tube that is attached to the APPLICATOR from the LID. (Note: The LID will remain on the flat hard surface due to the suction cup bottom being secured on to a flat hard surface and attached to the lids base)
Figure 7B:
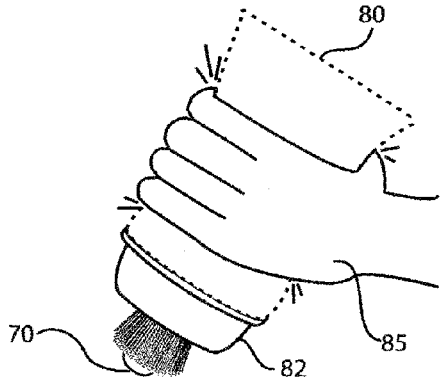
FIG. 7B is an illustration of step two of using the APPLICATOR, squeezing a desired amount of the tube's contents out from between the brush bristles of the APPLICATOR.
Figure 7C:
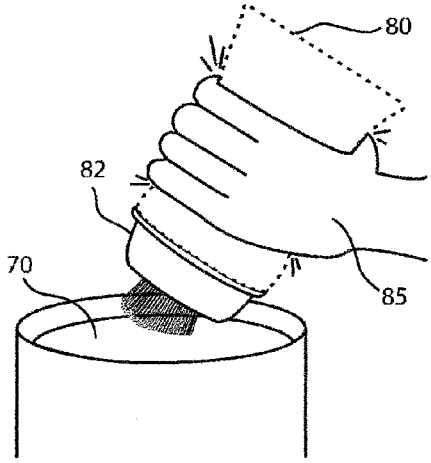
FIG. 7C is an illustration of an alternative to step two of using the APPLICATOR, dipping the brush bristles of the APPLICATOR into any desired container and its contents.
Figure 7D:
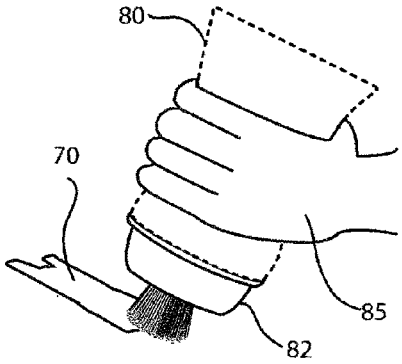
FIG. 7D is an illustration of step three of using the APPLICATOR, swiping the brush bristles covered by the tube's contents onto a desired surface area.
Figure 7E:
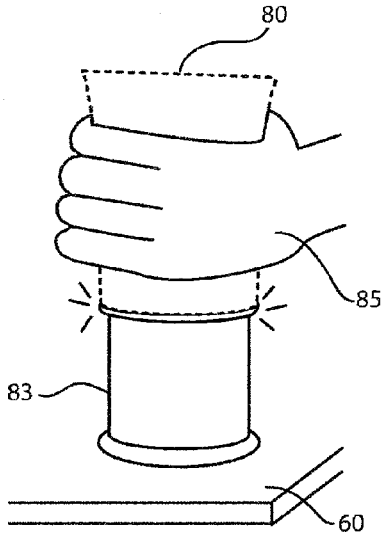
FIG. 7E is an illustration of step four of using the APPLICATOR and LID, placing the tube that is attached to the APPLICATOR into the LID.

Once the user has assembled the APPLICATOR and LID, the present invention is ready to be used. In order to see how to use the present invention, take your attention to FIGS. 7A, 7B, 7C, 7D, and 7E. Beginning with step (1) represented by FIG. 7A, use the tube 80 as a handle and pull up and away from LID 83 with a suction cup bottom. The APPLICATOR 82 should snap off, leaving the LID 83 with a suction cup bottom attached to the flat hard surface. Followed by step (2), which is shown in FIG. 7B, use the tube 80 as a handle and squeeze the tube 80 until a desired amount of its content such as cream 70 comes from between the brush bristles of the APPLICATOR 82. Another alternative or addition to step (2) is shown in FIG. 7C, where instead of squeezing the cream 70 out of the tube 80, the tube 80 is used as a handle to dip the brush bristles of the APPLICATOR 82 into the desired content, such as a container of cream 70. Step (3) is shown in FIG. 7D use the tube 80 (illustrated by a broken line) as a handle and swipe the desired area with the brush bristles of the APPLICATOR 80 covered in the cream 70. Step (3) allows for the user to apply the contents of the tube without contaminating his or her hand with the cream 70. Then step (4) is shown in FIG. 7E. Use the tube 80 as a handle and snap the APPLICATOR 82 into the LID 83 (with a suction cup bottom). Step (4) is especially easy due to the fact that the LID 83 (with a suction cup bottom) is in the upright position and ready for the APPLICATOR 80 to be snapped in and out of the LID 83 (with a suction cup bottom) with only one hand. This allows the user to have one free hand to hold a child steady. Following steps one through four, the user is able to perform the entire application process using only one hand, and without contaminating his or her hand with the desired contents.

Figure 8A:
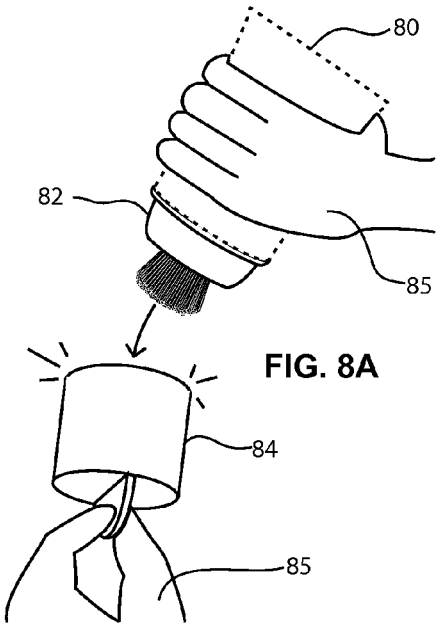
FIG. 8A is an illustration of step one of using the APPLICATOR and alternate LID (with a pull tab bottom), pulling on the tab with one hand while holding the tube that is attached to the APPLICATOR with the other hand.
Figure 8B:
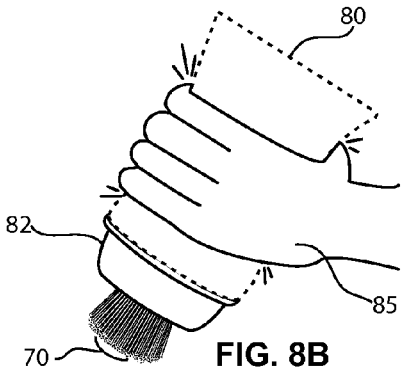
FIG. 8B is an illustration of step two of using the APPLICATOR with the alternate lid, squeezing a desired amount of the tube's contents out from between the brush bristles of the APPLICATOR. (Note: This is the same step that is illustrated in FIG. 7B).
Figure 8C:
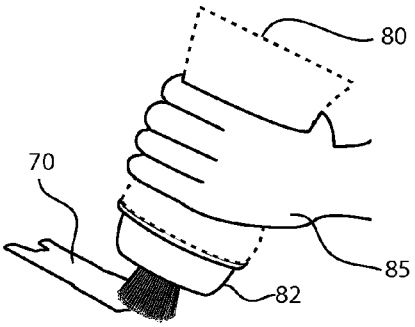
FIG. 8C is an illustration of step three of using the APPLICATOR, showing the hand swiping the brush bristles covered by the tube's contents onto a desired surface area. (Note: This is the same step that is illustrated in FIG. 7D).
Figure 8D:
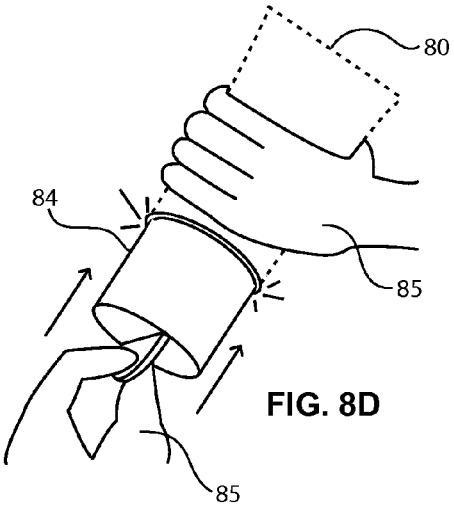
FIG. 8D is an illustration of step four of using the APPLICATOR and alternate LID (with a pull tab bottom), holding the tube that is attached to the APPLICATOR with one hand, while placing the LID over the APPLICATOR with the other hand.
Figure 8E:
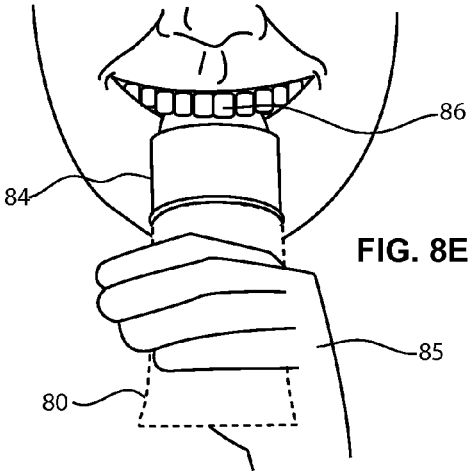
FIG. 8E is an illustration of an alternative method of steps one and four of opening and closing the LID, using teeth in place of the other hand.

The application process is slightly different when using the LID with the pull tab bottom. In order to better understand how to use the APPLICATOR with the LID that has a pull tab refer to FIGS. 8A, 8B, 8C and 8D: The pull tab is particularly useful in situations in which there is no flat surface to secure the suction cup bottom. In addition the pull tab bottom of the LID can be particularly useful when the user is on the go. Step (1) is illustrated by FIG. 8A. Hold the tube 80 with one hand and pull the tab of the LID 84 (with pull tab bottom) with the other hand 85. An alternative to step (1) is illustrated by FIG. 8E which shows an illustration of a user using his or her teeth or mouth 86 in replacement of the other hand 85 to pull the tab of the LID 84 (with pull tab bottom) off of the APPLICATOR 80. The benefit of this alternative is that it allows for the user to have one free hand in the process. Then step (2) is shown in FIG. 8B is the same as FIG. 7B: use the tube 80 as a handle and squeeze the tube 80 until a desired amount of its content such as cream 70 comes from between the brush bristles of the APPLICATOR 82. Followed by step (3) in FIG. 8C which is the same as FIG. 7D use the tube 80 (illustrated by a broken line) as a handle and swipe the desired area with the brush bristles of the APPLICATOR 80 covered in the cream 70. Then step (4) is represented in FIG. 8D. Hold the tube 80 with one hand 85 and snap the APPLICATOR 80 into the LID 84 (with a pull tab bottom) while holding the pull tab with the other hand 85. If the user decided to pull the LID 84 (with a pull tab bottom) with his or her mouth as illustrated in FIG. 8E, and kept the LID 84 (with a pull tab bottom) in his or her mouth 86 then she or he will be able to place the APPLICATOR 80 back into the LID 84 (with a pull tab bottom) while using only one hand 85.

While the above description contains many specifics, these should not be construed on the limitations of the scope of the invention, but rather as an exemplification of one (or several) of the preferred embodiments thereof. The scope of the invention should not be determined by the embodiments illustrated, but rather by the appended claims and their legal equivalents. Many other ramifications and variations are possible within the teachings of the various embodiments. There are many various forms that the present inventions parts can take. Each part can change in size, shape and material. They can have different cross sections, such as oval, triangular, rectangular, and so on; they can come in various sizes and be made up of many different materials, such as metals, plastics, woods, and ceramics. There are various ways in which each of the parts can be connected and attached (detached) from one another. In addition to that some of the preferred embodiments of the present invention could even be eliminated. Although it is impossible to cover every single possible ramification, I think the following are important enough to show how the present invention could be altered, while still being able to fix the problems associated with the prior art.

There are infinite types of uses for the present invention. Although I previously stated and described the present invention working in conduction with a tube of diaper rash cream, this does not limit my invention's use in any way. The same benefits that are applicable to using the present invention in the application of a diaper rash cream onto a child, can also be useful in applying other types of materials onto other types of surface areas. For example, when used to apply a facial mask, the present invention would prevent the user's fingers from getting messy, enable an even distribution of the content and an overall better feeling sensation of the application process due to soft bristle brushes. If the user chooses to use a tube of paint instead of a mask or cream, this will enable the user to a apply the paint on a desired area without the need to dip the brush into paint, thus enabling a faster and cleaner painting application process.

Although I stated in the preferred embodiment, that the present invention is to function with a tube; this does not limit my invention to only be used with a tube because a handle 21 can be an alternative to the tube. Refer to FIG. 2B.1 which shows a straight perspective view of the APPLICATOR attached to a handle 21. The handle 21 can be made out of thin flexible material such as plastic, aluminum, rubber or silicone and it can be hollow inside and be filled with any desired content. In addition the handle 21 can also be solid inside and be made out of plastic, a lightweight metal, wood, rubber or silicone. There are many shapes and sizes that the handle 21 can take form. In the preferred embodiment I designed a shape that can easily hand held. In FIG. 2B.1, you can see that the shape of the handle 21 has a circular circumference at its base that is similar in size of that of the top rim 33 of the applicator, and gradually gets slightly narrower and wide again towards to top. The shape of the handle 21 allows for a human hand to easily fit around the middle part of the handle 21. There are several ways in which the handle 21 can be either attached or connected to the tube. One way is the handle 21 can be a part of the APPLICATOR, with the bottom circular circumference of the handle 21 being permanently attached to the top rim 33 of the applicator by an adhesive or during the mold making process. Another way is that the handle 21 can be attached and detached to and from the APPLICATOR by having similar parts as the bottom portion of the TUBE, including male threads that can be twisted in place with the female threads of the APPLICATOR. These are only two examples; many other ways of attaching and detaching the handle 21 to and from the tube are also satisfactory.

Figure 5E:
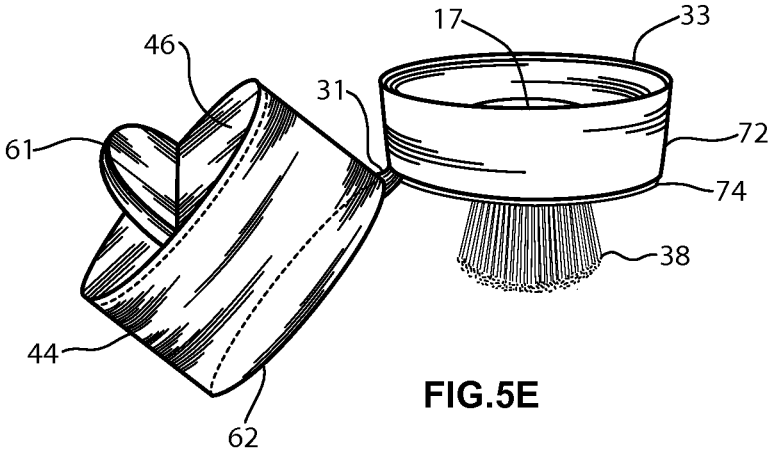
FIG. 5E is a perspective view of the APPLICATOR connected to the LID (with a pull tab bottom), by an attachment flap, with the LID in the open position.
Figure 5F:
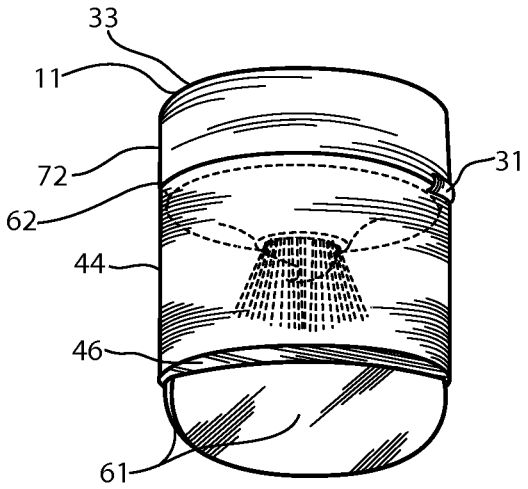
FIG. 5F is a perspective view of the APPLICATOR connected to the LID (with a pull tab bottom), by an attachment flap, with the LID in the closed position.

The various components of the APPLICATOR apparatus and the LID are typically to be made from a variety of well know plastics and therefore can be produced at a relatively low cost. However, it should be understood that various components of any the applicators and lids could be formed of any of variety of metals such as aluminum and would still be relatively light in weight. In addition there are many various alternatives and additives that could be added to either or both parts of the present invention. One of these possible alternatives is a connector flap 31, that is connects to a section of the top rim 33 of the APPLICATOR and to a section of the top rim 41 of the LID. Take a look at FIG. 5E, where in you can see a straight perspective view of the APPLICATOR connected to the LID (with a pull tab bottom), by an attachment flap, with the LID in the open position. And in FIG. 5F is a straight perspective view of the APPLICATOR connected to the LID (with a pull tab bottom), by an attachment flap, with the LID in the closed position. In this version of the invention the connector flap 31 allows for the user to keep the LID connected to the APPLICATOR during throughout the application process.

Based on all of the illustrations and descriptions, I have invented a novel combination of an APPLICATOR and LID apparatus that thereby fulfills all of the objects and advantages that have been sought.

I claim:

1. A cream applicator and lid apparatus, comprising:

a dome-shaped applicator that is designed to replace the cap of a squeezable cream dispenser tube, said applicator having an inside surface and an outer exterior;

female threads on said inside surface of said applicator, designed to fit male threads of said tube;

a top rim of said applicator designed to fit snugly against a base of a body of said tube;

a hole rim in said outer exterior of said applicator, in the shape of an elongated slot, through which cream will be dispensed when said tube is squeezed;

cream application means attached around said hole base rim, for the purpose of smoothly and evenly applying said cream to an application surface;

a lid that is designed to snugly snap into place around said applicator and secure said applicator and said cream application means with an airtight seal;

a solid base exterior on said lid;

a suction cup base attached to said solid base exterior of said lid, for the purpose of securing said lid to a hard flat surface so that said applicator and said tube can be easily removed from said lid and used with one hand.

2. The apparatus of claim 1, wherein said cream application means are in the form of brush bristles.

3. The apparatus of claim 1, wherein said cream application means are in the form of a sponge.

* * * * *